United States Patent [19]

Usami

[11] Patent Number: 5,047,308

[45] Date of Patent: Sep. 10, 1991

[54] PROCESS FOR PREPARING PHOTO- AND HEAT-SENSITIVE RECORDING MATERIAL

[75] Inventor: Toshimasa Usami, Shizuoka, Japan

[73] Assignee: Fuji Photo Film Co., Ltd., Kanagawa, Japan

[21] Appl. No.: 209,382

[22] Filed: Jun. 21, 1988

[30] Foreign Application Priority Data

Jun. 22, 1987 [JP] Japan ..... 62-155212

[51] Int. Cl.[5] ..... G03C 1/74; G03C 1/52; B41M 5/18

[52] U.S. Cl. ..... 430/138; 430/168; 430/169; 503/213; 503/214; 503/215

[58] Field of Search ..... 430/138, 151, 168, 169; 503/213, 214, 215

[56] References Cited

U.S. PATENT DOCUMENTS

| | | | |
|---|---|---|---|
| 3,111,407 | 11/1963 | Lindquist et al. | 430/138 |
| 3,202,510 | 8/1965 | Hollmann | 430/138 |
| 4,497,887 | 2/1985 | Watanabe et al. | 430/138 |
| 4,598,035 | 7/1986 | Usami et al. | 430/151 |
| 4,686,547 | 8/1987 | Hayashi et al. | 430/151 |
| 4,737,484 | 4/1988 | Iwasaki et al. | 430/151 |
| 4,771,032 | 9/1988 | Yamaguchi et al. | 430/151 |
| 4,828,957 | 5/1989 | Yonese et al. | 430/151 |
| 4,840,933 | 6/1989 | Usami et al. | 503/213 |
| 4,956,251 | 9/1990 | Washizu et al. | 430/138 |

OTHER PUBLICATIONS

Partial English Translation of Japanese Publication (OPI) #244594/1985.

*Primary Examiner*—Charles L. Bowers, Jr.
*Attorney, Agent, or Firm*—Sughrue, Mion, Zinn, Macpeak & Seas

[57] ABSTRACT

This invention discloses a photo- and heat-sensitive recording material excellent in fixability comprising a support having on one side of which at least one photo- and heat-sensitive layer having a haze % of less than 60 and containing a diazo compound and a coupler, wherein either the diazo compound or the coupler is enclosed in a microcapsule and a process to manufacture it.

2 Claims, No Drawings

PROCESS FOR PREPARING PHOTO- AND HEAT-SENSITIVE RECORDING MATERIAL

FIELD OF THE INVENTION

The present invention relates to a heat-sensitive recording material excellent in fixability, and more particularly, to a photo- and heat-sensitive recording material which can be employed as a photo-sensitive material also.

BACKGROUND OF THE INVENTION

Photo- and heat-sensitive materials having on a support a photo- and heat-sensitive layer containing a diazo compound and a coupler have so far been known. Specifically, the recording materials of this type use the combination of a photo decomposable diazo compound, a coupler and a heat fusible substance, and take advantage of the coupling reaction between the diazo compound and the coupler, which takes place by heating to produce a color, and the decomposition of the diazo compound which takes place by exposure to light in the photolysis wave length region of the diazo compound, and thereby the above-described coloring reaction is hindered to effect the fixation. Therefore, the photo recording can be achieved by imagewise exposing the above-described recording material to light in the foregoing wave length region, and then heating the material up to a temperature higher than the melting point of the heat fusible substance. On the other hand, the heat-sensitive recording can be achieved by carrying out the heat recording, and then optically exposing all over the surface of the recording layer. Accordingly, when the above-described recording material is employed as a heat-sensitive recording material, the recorded image which has received fixation has a merit that it does not suffer from unnecessary color production in the background area, that is, it has excellent keeping quality, which is different from the case of heat-sensitive recording materials of leuco dye coloration type.

However, in analogy with the heat-sensitive recording material of leuco dye coloration type, the foregoing recording material causes fog during storage prior to processings, and so on. That is, it is insufficient mainly in freshness keeping property Therefore, various recording materials have so far been proposed with the intention of improving in freshness keeping property.

Among those recording materials, the recording material proposed by us (in Japanese Patent Application (OPI) No. 65043/83 (the term "OPI" as used herein means an unexamined published application)) is characterized by enmicrocapsulation of at least one component taking part in a color-producing reaction, e.g., at least either a diazo compound or a coupler, which involves forming a capsule wall around a core substance, which comprises at least one component participating in the color-producing reaction, through polymerization, whereby achieving an improvement in freshness keeping property without attend by lowering of a recording speed and a color density of developed image.

However, conventional recording materials, including the above-described recording material which utilizes enmicrocapsulation, are inferior in transparency. Therefore when images colored in various tints, e.g., red, blue, yellow, etc., are formed therein, the images become darkish, and lack in clearness. In addition, the whiteness in the background area is insufficient. More specifically, when color images recorded in a photo- and heat-sensitive layer provided on a transparent support are projected with an overhead projector (OHP) the conventional photo- and heat-sensitive recording materials suffer from the defects that the projected background looks darkish, so the contrast is lowered as a whole; and the projected color images look dull, too. Further, when multicolor recording is carried out using a photo- and heat-sensitive recording material in which two or more of photo- and heat-sensitive recording material in which two or more of photo- and heat-sensitive layers differing in color of the image to be produced are superposed upon one another, conventional recording materials have a problem that they are inferior in the reproducibility of mixed color in every overlapped area of images colored in different tints.

Though it is certain that these problems can be solved by the use of silver salt color photographic materials, these photographic materials also have different problems that they are expensive, and require a complex and time-consuming photographic processing in forming recorded images.

SUMMARY OF THE INVENTION

A first object of the present invention is to provide which not only makes it feasible to record at such a high speed as commercially produced diazo copying apparatuses and heat-sensitive recording printers are usable therefor, but also is excellent in freshness keeping property, color density of recorded image, and record keeping property, and further can record clear images therein at a low price without causing dullness in the background and the color images.

A second object of the present invention is to provide a photo- and heat-sensitive recording material which is excellent in transparency, and can produce such an image as to be projected on a screen in a good condition with an overhead projector.

A third object of the present invention is to provide a photo- and heat-sensitive recording material which is excellent in reproducibility of mixed color arising from overlapping of variously colored records, and therefore, suitable for multi-color recording.

Above objects of the present invention were attained by a photo- and heat-sensitive recording material comprising a support having on one side of which a photo and heat-sensitive layer containing a diazo compound and a coupler is provided, said photo- and heat-sensitive layer being transparent in a substantial sense, and formed by the process which comprises enmicrocapsulating either the diazo compound or the coupler, dissolving the remainder component into an organic solvent slightly soluble or insoluble in water, dispersing the resulting solution in the form of emulsion, mixing the thus obtained microcapsule solution and emulsified dispersion, coating the resulting mixture on one side of the support, and then drying the coat. Accordingly, the images formed therein enables various kinds of utilization as transmission color images, for instance, color display with an overhead projector.

DETAILED DESCRIPTION OF THE INVENTION

The diazo compounds to be used in the present invention are "photo-decomposable diazo compounds" decomposing on exposure to light of particular wavelengths prior to the reaction These diazo compounds are mainly aromatic diazo compounds, including aromatic diazonium salts, diazosulfonate compounds, diazoamino compounds and the like. The diazo compounds are illustrated below citing diazonium salts as typical examples.

In general, the wavelength at which diazonium salts undergo photolysis are said to be the wavelengths of their respective absorption maximum. In addition, the absorption maximum wavelength of a diazonium salt is known to vary between about 200 nm and about 700nm according to its chemical structure(Takahiro Tsunoda & Tsugio Yamaoka, Nippon Shashin Gakkaishi, vol. 29(4), pp. 197-205 (1965), the title of which means "photolysis of photo-sensitive diazonium salts and chemical structures thereof", can be referred to). Namely, when diazonium salts are employed as a photodecomposable compound, they decompose upon exposure to light of wavelengths specified depending on their respective chemical structures, and the hue of a dye to be produced by coupling reaction can be varied by using the diazonium salts of a modified chemical structure even when the same coupling component is used.

The diazonium salts are compounds represented by the general formula of $ArN_2^+ X^-$(wherein Ar represents a substituted or unsubstituted aromatic moiety, $N_2^+$ represents a diazonium group, and $X^-$ represents an acid anion).

Specific examples of diazonium compounds having their respective photolysis wavelengths in the vicinity of 400 nm include 4-diazo-1-dimethylaminobenzene, 4-diazo-1-diethylaminobenzene, 4-diazo-1-dipropylaminobenzene, 4-diazo-1 - methylbenzylaminobenzene, 4-diazo-1 -dibenzylaminobenzene, 4 - diazo-1-ethylhydroxyethylaminobenzene, 4-diazo-1-diethylamino-3methoxybenzene, 4-diazo-1-dimethylamino-2-methylbenzene, 4-diazo-1-benzoylamino-2,5-diethoxybenzene, 4-diazo-1-morpholinobenzene, 4 -diazo-1-morpholino-2,5 -diethoxybenzene, 4-diazo-1-morpholino-2,5-dibutoxybenzene, 4 diazo-1-anilinobenzene, 4-diazo-1-toluylmercapto-2,5-diethoxybenzene, 4-diazo- 1,4-methoxybenzoylamino-2,5-diethoxybenzene, and so on. Specific examples of compounds having their photolysis wavelengths in the range of 300 to 370 nm include 1-diazo-4(N,N-dioctylcarbamoyl)benzene, 1-diazo-2-octadecyloxybenzene, 1-diazo-4-(4-tert-octyl-phenoxy)benzene, 1-diazo-4-(2,4-di-tert-amylphenoxy) benzene,1-diazo-2-(4-tertoctylphenoxy)benzene, 1-diazo-5-chloro-2-(4-tertoctylphenoxy)benzene,1-diazo-2,5-bis-octadecyloxybenzene, 1-diazo-2,4-bis-octadecyloxybenzene, 1-diazo-4-(N-octyltauroylamino)benzene, and so on. Photolysis wavelengths of the aromatic diazonium compounds represented by the above-cited examples can be changed over a wide range by replacing their individual substituent groups by other arbitrary ones.

Specific examples of acid anions include
$C_nF_{2n+1}COO^-$(n=an integer of 3 to 9),
$C_mF_{2m+1}SO_3^-$(m=an integer of 2 to 8),
$(C\ F_{21+1}SO_2)_2CH^-$(l=an integer of 1 to 18),

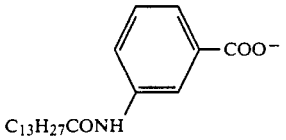

-continued

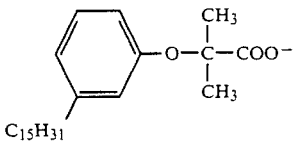

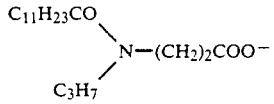

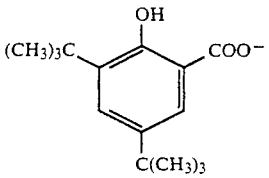

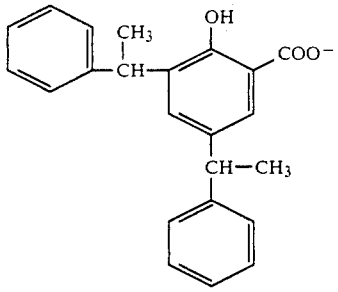

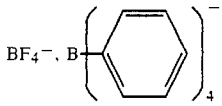

$PF_6^{31}$, and so on.

Specific examples of diazonium compounds (idazonium salts) are illustrated below.

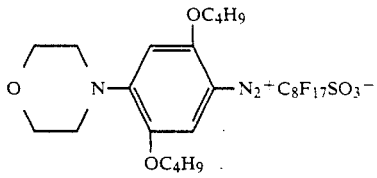

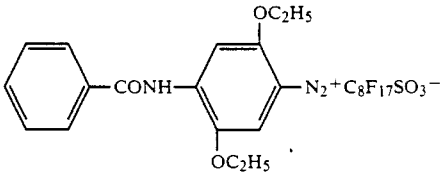

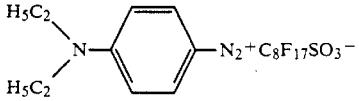

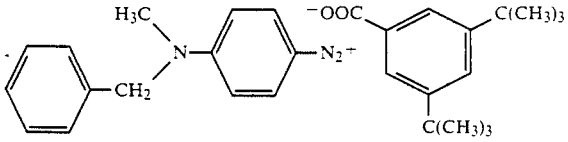

-continued

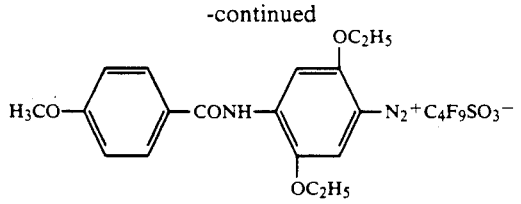

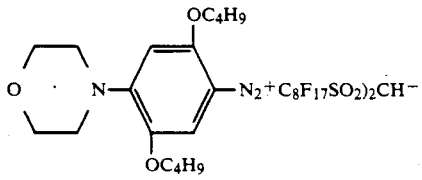

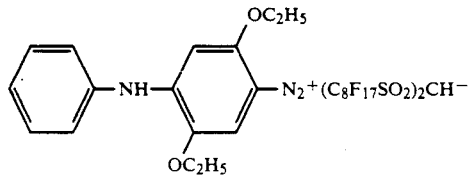

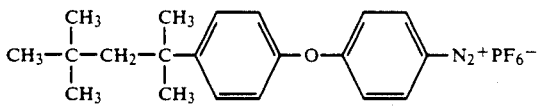

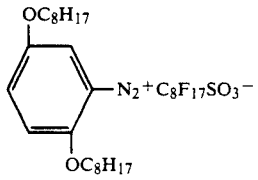

Diazosulfonate compounds which can be used in the present invention are those represented by the following general formula:

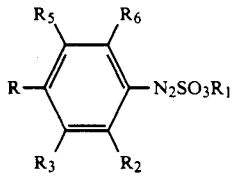

wherein $R_1$ represents an alkali metal, or an ammonium compound; $R_2$, $R_3$, $R_5$ and $R_6$ each represents a hydrogen atom, a halogen atom, an alkyl group, or an alkoxyl group; and $R_4$ represents a hydrogen atom, a halogen atom, an alkyl group, an amino group, a benzoylamido group, a morpholino group, a trimercapto group, or a pyrrolidino group.

Many compounds are known as such diazosulfonates, and can be obtained by treating the corresponding diazonium salts with a sulfite.

Preferred examples of diazosulfonate compounds include benzenediazosulfonates having such a substituent group as 2-methoxy, 2-phenoxy, 2-methoxy-4-phenoxy, 2,4-dimethoxy, 2-methyl-4-methoxy, 2,4-dimethyl, 2,4,6-trimethyl, 4-phenyl, 4-phenoxy, 4-acetoamide, or so on; and benzenediazosulfonates having such a substituent group as 4-(N-ethyl-N-benzylamino), 4-(N,N-dimethylamino), 4-(N,N-dimethylamino), 4-(N,N-diethylamino)-3-chloro, 4-pyrrolidino-3-chloro, 4-morpholino-2-methoxy, 4-(4'-methoxybenzoylamino)-2,5-butoxy, 4-(4'-trimercapto)-2,5-dimethoxy, or so on. When these diazosulfonate compounds are used, it is desired that optical exposure should be carried out before printing for the purpose of activation of the diazosulfonates.

Other diazo compounds which can be used in the present invention are diazoamino compounds. Specific examples thereof include those obtained by coupling diazo group with dicyandiamide, sarcosine, methyltaurin, N-ethylanthranic acid-5-sulfonic acid, monoethanolamine, diethanolamine, guanidine, etc.

The couplers are compounds which form colors by coupling with diazonium compound (diazonium salts).

Specific examples of couplers which can be used include a resorcinol, phloroglucinol, sodium-2,3-dihydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanylnaphthalene, 2-hydroxy-3-naphthoic acid morpholinopropylamide, 2-hydroxy-3-naphthoic acid morpholinopropylamide, 2-hydroxy3-naphthoic acid-2'-methylanilide, 2-hydroxy-3-naphthoic acid ethanolamide, 2-hydroxy-3-naphthoic acid octylamide, 2-hydroxy-3-naphtoic acid-N-dodecyloxy-propylamide, 2-hydroxy-3-naphthoic acid tetradecylamide, acetanilide, acetoacetanilide, benzoyl acetanilide, 1-phenyl-3-methyl-5-pyrazolone, 1-(2',4 ',6'-trichrorophenyl)-3-benzamide-5-pyrazolone, 1-(2',4',6'-trichrorophenyl)-3-anilino-5-pyrazolone, 1-phenylacetamide-5-pyrazolone.

By employing two or more of these coupling components, images of any color tones can be obtained.

It is desirable to add a basic substance to a recording layer of the present invention's photo- and heat-sensitive recording material in order to accelerate a coupling reaction.

Suitable basic substances include those soluble slightly or insoluble in water, and substances capable of producing an alkali upon heating.

As examples of such substances, mention may be made of inorganic and organic ammonium salts, organic amines, amides, urea and thiourea, derivatives of these ureas, thiazoles, pyrroles, pyrimidines, piperazines, guanidines, indoles, imidazoles, imidines, formamidines, pyridines, and other nitrogen containing compounds. More than two basic substances may be employed together In a photo- and heat-sensitive recording material of the present invention, a thermocoloring sensitizer such as a hydroxyl compound, a carbamate compound, an aromatic methoxy compound and an organic sulfonamide compound may be added in a photosensitive layer in order to carry out thermal development completely by a low energy. These compounds seems to lower a melting point of coupling components or a basic substances, or seems to improve a thermopermeability of a microcapsule wall, therefore, an image density when the photo- and heat-sensitive recording material is used becomes higher.

Among the above mentioned components relating to the coloring reaction, diazo compounds or couplers are enclosed in the microcapsules from view points such as improving transparency of the photo- and heat-sensitive layer, freshness keeping property by preventing a contact of diazo compounds with couplers at ordinary temperature (fog prevention) and controlling a coloring sensitivity to color with desired thermal energy to be added.

Microcapsules preferably employed in the present invention have a microcapsule wall of such a property as to prevent the contact between substances present inside and outside the microcapsule at ordinary temperature through its insulation function, but to increase a permeability of the substances only while it is heated to a temperature higher than a prescribed one. This phenomenon discovered by us previously belongs to new technology. A permeation starting temperature can be freely controlled by properly chosing a capsule wall material, a capsule core material, and additives. In this case, the permeation starting temperature corresponds to the glass transition point of the capsule wall (as described, e.g., in Japanese Patent Application(OPI) No. 91438/84,Japanese Patent Application Nos. 190886/84 and 99490/84, and so on).

For controlling the intrinsic glass transition point of a capsule wall, it is necessary to change the kind of a capsule wall-forming agent.

Examples of macromolecular substances for capsule wall are a polyurethane, a polyurea, polyamide, polyester, polycarbonate, urea-formaldehyde resin, melamine resin, polystyrene, styrene-methacrylate copolymer, styrene acrylate copolymer, gelatin, poly(vinylpyrrolidone), poly(vinylalcohol), etc. These macromolecular substances can be used as a combination of two or more in the present invention.

Also, among the above substances, a polyurethane, polyurea, polyamide, polyester or polycarbonate is preferred in this invention. Especially, polyurethane and polyurea are preferable.

As for the microcapsule used in the present invention, it is desirable to manufacture microcapsule by forming a wall of a macromolecular substance around the oil drop obtained by emulsifying a core substance containing a diazo compounds or couplers.

In this case the reactant to form a macromolecular substance is added inside and/or outside the oil drop. Details of the microcapsules, which are used preferably in the present invention, such as a method to manufacture the microcapsule are described, e.g., in Japanese Patent publication(OPI) 222716/'86.

An organic solvent to be used for forming oil drop can be properly selected from those having high boiling points.

Microcapsules can be formed by the use of emulsion containing an ingredient to be microencapsulated in a concentration of 0.2 wt % or more.

It is desirable to use the coupling compound and basic substance in amounts of 0.1 to 10 parts by weight and 0.1 to 20 parts by weight, respectively, per 1 part by weight of the diazo compound.

Desirable microcapsules which are produced in the above-described manner are not those of the kind which are ruptured by heat or pressure, but those of the kind which have a microcapsule wall through which reactive substances present inside and outside the individual microcapsules respectively can permeate at high temperature to react with each other.

In the present invention, a color-producing aid can be used.

A usable color-producing aid is such a substance as to heighten a density of color produced by heating, or to lower a minimum color-production temperature. More specifically, it is used for creating a condition under which a diazo compound, a basic substance, a coupler and so on can readily undergo reactions with one another through a melting point-lowering action thereof on the diazo compound, etc., or a softening point-lowering action thereof on the capsule wall.

As examples of color-producing aids which can be used, mention may be made of phenol compounds, alcoholic compounds, amide compounds, sulfonamide compounds, and so on. Specific examples of these compounds include p-tertoctylphenol, p-benzyloxyphenol, phenyl p-oxybenzoate, benzyl carbanilate, phenetyl carbanilate, hydroquinone dihydroxyethyl ether, xylylene diol, N-hydroxyethylmethanesulfonic acid amide, N-phenyl-methanesulfonic acid amide, and so on. Such a substance as described above may be incorporated into a core substance, or may be added to a medium present outside the microcapsules in the form of emulsified dispersion.

In order to obtain a substantially transparent photo and heat-sensitive layer in the present invention, a coupler in case of enmicrocapsulating a diazo compound, or a diazo compound in the reverse case is used in the form of dispersion prepared by dissolving it in an organic solvent slightly soluble or insoluble in water, and then mixing with an aqueous solution containing a surface active agent, and a water-soluble high polymer as a protective colloid to effect emulsification. In many cases, any component, whether it is a diazo compound or not, may be enmicrocapsulated, or made into an emulsified dispersion. However, it is particularly preferred that a diazo compound is incorporated into microcapsules, while a coupler is chosen as the component for emulsified dispersion.

An organic solvent to be used for dissolving the color developers can be properly selected from oils having high boiling point. Preferred examples of such oils include esters, compounds represented by the following general formula (I) to (IV), triarylmethanes (such as tritoluylmethane, toluyldiphenylmethane, and the like), terphenyl compounds (such as terphenyl), alkylated diphenyl ethers (such as propyldiphenyl ether), hydrogenated terphenyl compounds (such as hexahydroterphenyl), diphenyl ethers, and so on.

Of these oils, esters are particularly preferred in the present invention from standpoints of stabilization of emulsified dispersion.

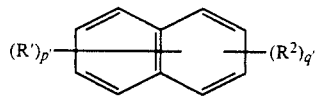

(I)

In the above formula, $R^1$ represents a hydrogen atom, or an alkyl group containing 1 to 18 carbon atoms; $R^2$ represents an alkyl group containing 1 to 18 carbon atoms; and $p^1$ and $q^1$ each represents an integer of 1 to 4, provided that the total number of alkyl groups therein is 4 or less. Preferred alkyl groups represented by $R^1$ and $R^2$ are those containing 1 to 8 carbon atoms.

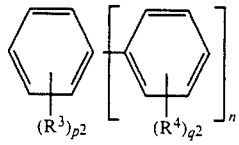

(II)

In the above formula, $R^3$ represents a hydrogen atom, or an alkyl group containing 1 to 12 carbon atoms; $R^4$ represents an alkyl group containing 1 to 12 carbon atoms; and n is 1 or 2. $p^2$ and $q^2$ each represents an integer of 1 to 4. The total number of alkyl groups is 4 or less in case of n−1, while it is 6 or less in case of n=2.

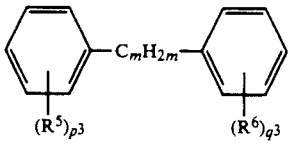

(III)

In the above formula, $R^5$ and $R^6$, which may be the same or different, each represents a hydrogen atom, or an alkyl group containing 1 to 18 carbon atoms m represents an integer of 1 to 13. $r^3$ and $q^3$ each represents an integer of 1 to 3, provided that the total number of alkyl groups is 3 or less.

Of alkyl groups represented $R^5$ and, $R^6$, those containing 2 to 4 carbon atoms are particularly preferred.

Specific examples of the compounds represented by the formula (I) include dimethylnaphthalene, diethylnaphthalene, diisopropylnaphthalene, and the like.

Specific examples of the compounds represented by the formula (II) include dimethylbiphenyl, diethylbiphenyl, diisopropylbipheny., diisobutylbiphenyl, and the like.

Specific examples of the compounds represented by the formula (III) include 1-methyl-1-dimethylphenyl-1-phenylmethane, 1-ethyl-1-dimethylphenyl-1-phenylmethane, 1-propyl-1-dimethylphenyl-1-phenylmethane, and the like.

Specific examples of esters include phosphates (e.g., triphenyl phosphate, tricresyl phosphate, butyl phosphate, octyl phosphate, cresyl-bi-phenyl phosphate), phthalates (e.g., dibutyl phthalate, 2-ethylhexyl phthalate, ethyl phthalate, octyl phthalate, buthlbenzyl phthalate, tetrahydro dioctyl phthalate, benzoates (e.g., ethylbenzoate, propyl benzoate, butyl benzoate, isopentyl benzoate, benzyl benzoate), abietates(e.g., ethyl abietate, benzyl abietate), dioctyl adipate, isodecyl succinate, dioctyl azelate, oxalates (e.g., dibutyl oxalate, dipentyl oxalate), diethyl malonate, maleates (e.g., dimethyl maleate, diethyl maleate, dibutyl maleate), tributyl citrate, sorbic esters (methyl sorbate, ethyl sorbate, butyl sorbate), sebacic esters (dibutyl sebacate, dioctyl sebacate), ethyleneglycol esters (e.g., formic acid monoesters and diesters, butyric acid monoesters and diesters, lauric acid monoesters and diesters, palmitic acid monoesters and diesters, stearic acid monoesters and diesters, oleic acid monoesters and diesters), triacetin, diethylcarbonate, diphenylcarbonate, ethylenecarbonate, propylenecarbonate, boric acid esters (e.g., tributyl borate, tripentyl borate).Of these esters, it is particularly preferred to use tricresyl phosphate from the standpoint of stabilization of emulsified dispersion of the color developers.

The above-cited oils can be used as a mixture of two or more thereof, or in combination with other oils.

Further, auxiliary solvents, which have low boiling points and act as dissolution aid, can be added to the foregoing organic solvents in the present invention. As examples of particularly preferred auxiliary solvents, mention may be made of ethyl acetate, isopropyl acetate, butyl acetate, methylene chloride, and the like.

Water soluble high polymers to be contained as a protective colloid in an aqueous phase, which is to be mixed with an oily phase wherein color developers are dissolved, can be selected properly from known anionic, nonionic or amphoteric high polymers. Of these high polymers, polyvinylalcohol, gelatin, cellulose derivatives and the like are preferred.

Surface active agents to be contained additionally in the aqueous phase can be selected properly from anionic or nonionic surface active agents of the kind which do not cause any precipitation or condensation by interaction with the above-described protective colloids. As examples of surface active agents which can be preferably used, mention may be made of sodium alkylbenzenesulfonates (such as sodium laurylbenzenesulfonate), sodium dioctylsulfosuccinates, polyalkylene glycols (such as polyoxyethylene nonylphenyl, ether) and so on.

An emulsified dispersion to be used in the present invention can be prepared with ease by mixing an oil phase containing the above mentioned components and an aqueous phase containing a protective colloid and a surface active agent with a general means for preparing a fine grain emulsion, such as a high-speed stirrer, an ultrasonic disperser or so on, to disperse the former phase into the latter phase.

An oil size (diameter) of the emulsified dispersion is desired to be less than 7 micron to obtain transparent heat sensitive layer having a haze % value of 60, particularly from 0.1 to 5 micron is preferable.

A value of ratio (weight of oil phase/weight of aqueous phase) is desired to be from 0.02 to 0.6, especially, from 0.1 to 0.4. If the value is less than 0.02, the color developer emulsified dispersion becomes too diluted one since the aqueous phase becomes too much and sufficient coloring can not be obtained. On the other hand when the value becomes larger than 0.6, handling becomes troublesome since a viscosity of the solution becomes high, moreover, the transparency of an obtained heat sensitive layer becomes low.

In preparing the heat sensitive material of the present invention, a proper binder can be used for coating.

Suitable examples of binders which can be used include polyvinyl alcohol, methyl cellulose, carboxymethyl cellulose, hydroxypropyl cellulose, gum arabic, gelatin, polyvinyl pyrrolidone, casein, styrene-butadiene latex, acrylonitrile-butadiene latex, and various kinds of emulsions of polyvinylacetate, polyacrylic acid esters, ethylene-vinylacetate copolymer and so on. Such a binder is used at a coverage of 0.5 to 5 $g/m^2$ on a solids basis.

In addition to the above-described ingredients, an acid stabilizer, such as citric acid, tartaric acid, oxalic acid, boric acid, phosphoric acid, pyrophosphoric acid, etc., can be added in this invention.

Images formed in the photo- and heat-sensitive material of the present invention can be observed as transmission images or reflection ones from one side of a transparent support. In the latter case, however, images are not clear because of see-through background. Therefore, a white pigment may be added to the photo- and heat-sensitive layer, or a layer containing a white pigment may be additionally provided in order to make the background look white. In both cases, it is effective to apply such means to the outermost layer situated on the side opposite to the observation side. Suitable examples of white pigments which can be used include talc, calcium carbonate, calcium sulfate, magnesium carbonate, magnesium hydroxide, alumina, synthetic silica, titanium oxide, barium sulfate, kaolin, calcium silicate, urea resin, and so on.

A size of dispersed particles is preferably 10 microns or less. A preferred coverage of the photo- and heat-sensitive layer ranges from 3 to 20 g/m$^2$, particularly from 5 to 15 g/m$^2$. When the coverage is below 3 g/m$^2$, sufficient sensitivity cannot be achieved, while when it is above 20 g/m$^2$, a further improvement in quality cannot be observed, so the cost is increased in vain.

As for the photo- and heat-sensitive layer of the present invention, at least one constituent layer must be transparent in a substantial sense in order to bring about an improvement in color separation. The expression "transparent in a substantial sense" as used herein means to be 60 % or less, preferably 50 % or less, and more preferably 30 % or less expressed in terms of Haze (%) (measured with an integrating sphere process HTR meter, made by Nippon Seimitsu Kogyo K.K.). On the other hand, light scattering due to fine unevenness at the surface of the photo- and heat-sensitive layer has a great influence upon the transparency of an actual test sample of the photo- and heat-sensitive layer. Accordingly, when the transparency inherent in the photo- and heat-sensitive layer to be made a subject of discussion in the present invention, that is, the transparency inside the photo- and heat-sensitive layer is intended to determine by measurement with a haze meter, a transparent adhesive tape is applied to the surface of the photo- and heat-sensitive layer as a simple means to attain the almost complete removal of surface scattering. In the above-described manner, the transparency is evaluated.

As for a protective layer which is optionally provided on the photo- and heat-sensitive layer in the present invention, a layer comprising a silicon-denatured polyvinyl alcohol and colloidal silica is favored over others.

Any type of silicon-denatured polyvinyl alcohol may be used if they contain silicon atoms in a molecule. However, polyvinyl alcohols in which silicon atoms are introduced in such a condition that reactive substituent groups, such as an alkoxy group, an acyloxy group, hydroxy group obtained by hydrolysis or an alkali metal salt thereof, or so on, are attached thereto are preferred.

Methods for synthesizing such denatured polyvinyl alcohols containing silicon atoms in a molecule are described in detail in Japanese Patent Application (OPI) No. 193189/83.

Colloidal silica in the present invention is used in the form of colloidal solution containing water as dispersion medium, which is prepared by dispersing very fine particles of silicic acid anhydride into water. Preferred colloidal silica particles have a size ranging from 10 to 100 microns, and a specific gravity of 1.1 to 1.3. The pH of the colloidal solution is preferably adjusted to about 4 to 10.

When the foregoing protective layer is provided on the surface of the photo- and heat-sensitive recording material, the surface scattering phenomenon is depressed in analogy with the application of the transparent adhesive tape described above. It is a further surprise to find that the transparency of the protective layer is very high, and in its turn contributes to a further improvement in transparency of the photo- and heat-sensitive recording material as a whole. Furthermore, this protective layer can play an additional part of increasing the mechanical strength of the photo- and heat-sensitive layer surface when provided as the outermost layer, or preventing unnecessary color mixing from occurring between lamination layers when provided as an interlayer there between.

A proper mixing ratio of the silicon-denatured polyvinyl alcohol to the colloidal silica, in the present invention, is 0.5–3 parts by weight preferably 1–2 parts by weight of colloidal silica per 1 part by weight of silicon-denatured polyvinyl alcohol. If the amount of the colloidal silica is less than 0.5 part by weight, it can not bring sufficient effect for improvement on a transparency, and if it is used in an amount more than 3 parts by weight a crack occurs in the protective layer which reduces the transparency.

In the protective layer, more than one other polymers can be used together with above polymer. Some of these polymers are water soluble polymers such as a methylcellulose, a carboxymethylcellulose, a hydroxymethylcellulose, a starchs, a gelatin, a gum arabic, a casein, a hydrolyzed product of styrene-maleic anhydride copolymer, a hydrolyzed half-ester product of styrene-maleic anhydride copolymer, a polyvinylalcohol, a modified polyvinylalcohol with carboxyl group, a polyacrylamide derivatives, a polyvinyl pyrrolidone, a polystyrene sodium sulfate, a sodium alginate; styrene-butadiene rubber latex, acrylnitrile-butadiene rubber latex, methylacrylate-butadiene rubber latex, a water insoluble polymer such as polyvinylacetate emulsion. A preferred amount to be used together is from 0.01 to 0.5 part by weight per 1 part by weight of silicon-denatured polyvinyl alcohol.

In the protective layer, a pigment, metal soap, wax or cross-linking agent etc. can be added in order to improve matching of the photo- and heat-sensitive recording material with thermal head when thermal recording is performed or with heat roller for thermosetting after photo-recording.

Some of the pigments are a zinc oxide, a calcium carbonate, a barium sulfate, a titanium oxide, a lithopone, a talc, an agalmatolite, a kaolin, an aluminum hydroxide, an amorphous silica etc., an amount to be added is 0.005–0.2 times of an amount of total weight of polymer especially 0.01–0.05 times are preferable. An amount less than 0.005 times can not improve the matching of the photo- and heat-sensitive recording material with thermal head when thermal recording is performed or with heat roller for thermosetting after photo-recording, on the other hand an amount more than 0.2 times reduces both transparency and sensitivity of photo- and heat-sensitive recording material remarkably, which causes damage on commercial value.

Some of the metal soaps are an emulsion of metal salt of higher fatty acid (e.g., a zinc stearate, a calcium stearate, an aluminum stearate) etc., and it's amount to be added is 0.5–20 weight %, preferably 1–10 weight % against total weight of the protective layer. Some of the waxes are a paraffion wax, a microcrystalline wax, a carnauba wax, a methylol stearoamide, a polyethylene wax, an emulsion of silicone etc., and an amount thereof to be added is 0.5–40 weight %, preferable 1–20 weight % against total weight of the protective layer.

In a coating solution for the protective layer a surface active agent is added in order to prepare the protective layer uniforming on the photo- and heat-sensitive layer. Some of the active agents are an alkali metal salt of sulfosuccinic acid system and an active surface agent containing fluorine atoms etc., concretely they are a sodium salt or an ammonium salt etc., of a di-(2-ethylhexyl) sulfosuccinic acid or di-(n-hexyl) sulfosuccinic acid etc.

Other surface active agents or polymer electrolytes can also be added in the protective layer as an antistatic agent. A preferable amount of the protective layer to be coated is usually 0.2–5 g/m$^2$, particularly 1 g–3 g/m$^2$ at the solids coverage.

In the photo- and heat-sensitive recording material of the present invention, a support such as a paper of a synthesized resin film may be used.

As for the paper to be used as a support, neutralized paper which is sized with a neutral sizing agent like an alkylketene dimer and shows pH 6–9 upon hot extraction is employed to advantage in the respect of long-range preservation.

In order to prevent the penetration of a coating composition into paper, and in order to effect a close contact between a thermal head when thermal recording is performed or heat roller for thermosetting after photo-recording and a photo- and heat-sensitive recording layer, paper described in Japanese Patent Application (OPI) No. 116687/82, which is characterized by Stökigt sizing degree/(meter basis weight)$^2 \geqq 3 \times 10^{-3}$ and Bekk smoothness of 90 seconds or more, is used to advantage.

In addition, paper having optical surface roughness of 8 microns or less and a thicknes of 40 to 75 microns as described in Japanese Patent Application (OPI) No. 136492/83; paper a density of 0.9 g/cm$^3$ or less and optical contact rate of 15 % or more, as described in Japanese Patent Application (OPI) No. 69097/83; paper which is prepared from pulp having received a beating treatment till its freeness has come to 400 cc or more on a basis of Canadian Standard Freeness (JIS P81221) to prevent permeation of a coating composition thereinto, as described in Japanese Patent Application (OPI) No. 69097/83; raw paper made with a Yankee paper machine, which is to be coated with a coating composition on the glossy side and thereby, improvements on developed color density and resolution are intended, as described in Japanese Patent Application (OPI) No. 65695/83; raw paper which has received a corona discharge processing and thereby, its coating aptitude has been enchanced, as described in Japanese Patent Application (OPI) No. 35985/84; and so on can be employed in the present invention, and can bring about good results. In addition to the above-described papers, all supports which have so far been used for general heat sensitive recording papers can be employed as the support of the present invention.

Nextly, a transparent support employed in the present invention is described.

The transparent support to be used in the present invention include films of polyesters such as polyethylene terephthalate, polybutylene terephthalate and the like, cellulose derivative films like a cellulose triacetate film, a polystyrene film, polyolefin films such as a polypropylene film or a polyethylene film and the like and so on. These films may be used, independently or in a laminated form.

A preferred thickness of such a transparent support is within the range of 20 to 200 microns, particularly 50 to 100 microns.

A subbing layer may be employed in the present invention to heighten the adhesiveness between the transparent support and the photo- and heat-sensitive layer. As a material for forming the subbing layer, mention may be made of gelatin, synthetic high polymer latexes, nitrocellulose, and so on. A preferred coverage of the subbing layer ranges from 0.1 to 2.0 g/m$^2$, particularly from 0.2 to 1.0 g/m$^2$. When the coverage is below 0.1 g/m$^2$, adhesion of the photo- and heat-sensitive layer to the support is insufficient, whereas even when it is increased beyond 2.0 g/m$^2$, the adhesion power attains saturation to bring about only increase in cost.

It is to be desired that the subbing layer should be hardened with a hardener because it sometimes swells by water contained in the photo- and heat-sensitive layer coated thereon.

As examples of hardeners which can be used in the present invention, mention may be made of:

(1) active vinyl-containing compounds, such as divinylsulfone, N,N'-ethylenebis(vinylsulfonylacetamide), 1,3-bis(vinylsulfonyl)-2-propanol, methylenebismaleimide, 5acetyl-1,3-diacryloyl-hexahydro-s-triazine, 1,3,5-triacryloyl-hexahydro-s-triazine, 1,3,5-trivinylsulfonylhexahydro-s-triazine, and the like, (2) active halogen-containing compounds, such as sodium salt of 2,4-dichloro-6-hydroxy-s-triazine, 2,4-dichloro-6-methoxy-s-triazine, sodium salt of 2,4-dichloro-6(4-sulfoanilino)-s-triazine, 2,4-dichloro-6(2-sulfoethylamino)-s-triazine, N,N'-bis(2-chloroethylcarbamyl)piperazine, and the like, (3) epoxy compounds, such as bis(2,3-epoxypropyl)-methylpropylammonium-p-toluenesulfonate, 1,4-bis(2',3'-epoxypropyloxy)-butane, 1,3,5-triglycidylisocyanurate, 1,3-diglycidyl-5-($\gamma$-acetoxy-$\beta$-oxypropyl)isocyanurate, and the like.

(4) ethyleneimino compounds such as 2,4,6-triethylene-s-triazine, 1.6-hexamethylene-N,N'-bisethyleneurea, bis-$\beta$-ethyleneminoethylthioether, and the like, (5) methanesulfonate compounds, such as 1,2-di(methane-sulfonoxy)ethane, 1,4-di(methanesulfonoxy)-butane, 1,5-di(methanesulfonoxy)pentane, and the like, (6) carbodiimide compounds, such as dicyclohexylcarbodimide, 1-cyclohexyl-3(3-trimethylaminopropyl)carbodiimido-p-triethanesulfonate, 1ethyl-3-(3-dimethylaminopropyl)carbodiimide hydrochloride, and the like, (7) isooxazole compounds, such as 2,5-dimethylisooxazole perchlorate, 2-ethyl-5phenylisooxazole-3sulfonate, 5,5'-(p-phenylene)bisisooxazole, and the like,

(8) inorganic compounds, such as chrome alum, bolic acid, zirconium salt, chromium acetate, and the like, (9) dehydrating condensation type peptide reagents such as N-carboethoxy-2-isopropoxy-1,2-dihydroquinoline, N-(1-morpholinocarboxy)-4-methylpyridinium chloride and the like, and active ester compounds such as N,N'-adipoiyldioxydisuccinimide, N,N'-terephthaloyl-dioxy-disuccinimide and the like, and

(10) isocyanates, such as toluene-2,4-diisocyanate, 1,6-hexamethylenediisocyante and the like.

(11) aldehydes such as glutaric aldehyde, glyoxal, dimethoxy urea, 2,3-dihydroxy-1,4dioxane and the like.

Among these hardeners, especially aldehydes such as glutaric aldehyde, or 2,3-dihydroxy-1,4-dioxane, and boric acid are preferable.

Such a hardner is added in a proportion ranging from 0.20 to 3.0 wt% to the weight of the materials to constitute the subbing layer. A proper amount to be added can be selected depending on the coating method, the intended degree of hardening.

When the addition amount of a hardener is below 0.20 wt%, sufficient hardening can not be achieved however long the time elapsed is, and therefore the subbing layer swells upon coating of the photo-sensitive layer, whereas when the hardener is added in a concentration higher than 3.0 wt% the hardening proceeds too fast, and therefore the adhesiveness between the subbing layer and the support is lowered to result in peeling off the subbing layer from the support.

According to the hardener used, the pH of a coating solution for the subbing layer can be rendered alkaline by the addition of sodium hydroxide or the like, or acidic by the addition of citric acid or the like, if needed.

Further, a defoaming agent can be added in order to eliminate foams generated upon coating, and a surface active agent can also be added in order to level the surface of the coating solution in a good condition to result in prevention of coating streaks.

Furthermore, an antistatic agent can be added, if needed.

Before coating of the subbing layer, the surface of a support is preferably subjected to an activation processing according to known methods. As a method for the activation processing, mention may be made of an etching processing with an acid, a flame processing with a gas burner, a cornea discharge processing, glow discharge processing, and so on. From the viewpoint of cost or simplicity, corona discharge processing described in U.S. Pat. Nos. 2,715,075, 2,846,727, 3,549,406 and 3,590,107, and so on are employed to the greatest advantage.

The photo-and heat-sensitive recording material is fundamentally comprised of a support having above mentioned essentially transparent photo- and heat-sensitive layer on one side thereof. Therefore, various embodiments are able to realize the present invention according to a use and a purpose: e.g. a recording material comprised of a support having directly thereon more than two photo- and heat-sensitive layers coloring in different hue each other, wherein, protectiver layer or subbing layer may be provided optionally; a recording material comprised of support having thereon a known layer selected from a group consisting of photo sensitive layer, heat sensitive layer and photo- and heat-sensitive layer, and further a substantially transparent photo-and heat-sensitive layer explained in the specification, wherein the latter layer colors in different hue to the former layer.

Coating compositions prepared in accordance with the present invention are coated using a dip coating process, an air knife coating process, a curtain coating process, a roller coating process, a doctor coating process, a wire bar coating process, a slide coating process, a gravure coating process, an extrusion coating process, using a hopper described in U.S. Pat. No. 2,681,294, or so on. Two or more of different coating compositions can be coated simultaneously, if desired, using methods described in U.S. Pat. Nos. 2,761,791, 3,508,947, 2,941,898 and 3,526,528, Yuji Harasaki, Coating Kogaku (which means "Coating Engineering"), p. 253, Asakura Shoten (1973), and so on. An appropriate method can be chosen from the above-cited ones depending on intended coverage, coating speed, and so on.

In the coating compositions of the present invention, it is allowed to compound properly a pigment dispersing agent, a viscosity increasing agent, a fluidity modifying agent, a deforming agent, a foam inhibitor, a mold lubricant, a coloring agent and so on far as they have no adverse influences upon characteristics.

In the photo- and heat-sensitive recording material of the present invention, images excellent in fixability can be recorded by a process comprising the step of carrying out duplication by imagewise exposure to light in photolysis wave length region of photo-decomposable diazo compounds, or photo recording by point exposure utilizing a light valve, such as a liquid crystal light valve, etc., and uniformly heating the photo- and heat-sensitive layer with a hot roller up to a temperature higher than a heat fusion temperature of the heat sensitive material including microcapsules to result in color development; or by the other process comprising the steps of carrying out heat recording with a thermal head, and through exposure to light in the above-described wave length region. As for the light source for photolysis, various light sources which can emit light of desired wavelengths can be used. For example, various types of fluorescent lamps, a xenon lamp, a xenon flash lamp, mercury lamps in which mercury vapor is enclosed at various pressures, a photographic flash, Strobe, etc., can be employed as light source. To make an additional remark, a light source part and a light exposure part may be separated with an optical fiber.

The photo- and heat-sensitive recording material of the present invention not only demonstrates high sensitivity to light upon duplication by imagewise exposure or photo printing, and can be developed or fixed when heated at a constant temperature, but also has heat sensitivity high enough to achieve the low temperature high-speed heat recording, and can be fixed in a short time using a light source of comparatively low power. Therefore, it can be suitably used for various types of heat-sensitive recording and photo-sensitive recording.

Further, the photo- and heat-sensitive recording material of the present invention is excellent in transparency, and can provide recorded color images excellent in transparency by heat-sensitive recording and photo-sensitive recording.

Furthermore, the photo- and heat-sensitive recording material of the present invention can produce recorded images which have high transparency in both background and color-image areas, so it can demonstrate excellent reproducibility of mixed color when transparent color images are overlapped. That is, the recording material of the present invention can be suitably used for multicolor recording.

EXAMPLES

The present invention will now be illustrated in more detail by reference to the following examples. However, the present invention should not be construed as being limited to these examples.

Additionally, in the following examples, all parts are by weight unless otherwise indicated.

Example 1.

Preparation of Capsule Solution (A):

Diazo Compound illustrated below

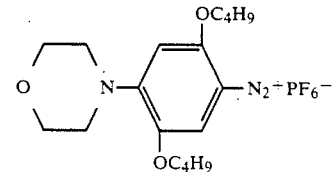

3.4 parts

Tricresyl Phosphate 6 parts

-continued

| | |
|---|---|
| Methylene Chloride | 12 parts |
| Trimethylolpropane Trimethacrylate | 18 parts |
| Takenate D-110N(75 wt % ethyl acetate solution, produced by TAKEDA YAKUHIN KOGYO K.K.) | 24 parts |

The above-described ingredients were mixed, and added to a water solution prepared by mixing 63 parts of a 8 wt% water solution of polyvinyl alcohol and 100 parts of distilled water. The resulting mixture was converted to an emulsion having a mean particle size of 2 microns by a dispersion treatment at 20° C. The stirring of the emulsion was allowed to continue for 3 hours at 40° C.

Thereafter, the emulsion was cooled at 20° C. and thereto was added 100 cc of Amberlite IR-120B (trade name, product of Rohm & Haas Co.). The mixture was stirred for one hour, then passed through a filter. Thus, the capsule solution (A) was obtained.

Preparation of Coupler/Base Dispersion (A) (Emulsion)

(I). 4g wt% Water Solution of Polyvinyl Alcohol 170 parts (II). Coupler illustrated below

| | |
|---|---|
| 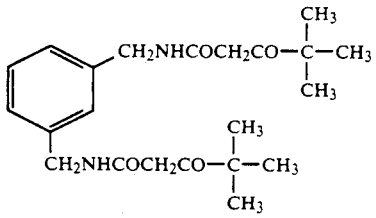 | 1.4 parts |
| Triphenylguanidine (base) | 6 parts |
| color-producing assistant | |
| 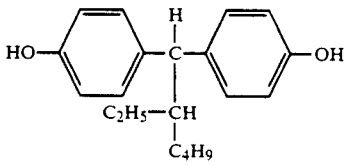 | 12.5 parts |
| and | |
| 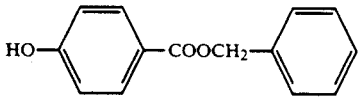 | 1.5 parts |
| Tricressyl phosphate | 10 parts |
| Ethyl acetate | 20 parts |

The solution (II) was added into the solution (I), then emulsified at 20 C to obtain dispersed emulsion having a mean particle size of 3 microns.

Preparation of Coating Composition (A)

| | |
|---|---|
| Capsule Solution (A) | 4.9 parts |
| Hydroqunone 5 wt % aqueous solution | 0.2 parts |
| Coupler/Base Dispersion (A) | 3.7 parts |

Above components were mixed with agitation to prepair coating solution (A).

Preparation of Coating Composition for Protective Layer

| | |
|---|---|
| silicon-denatured Polyvinyl alcohol (PVA R2105: manufactured by Kurare K.K.) | 1 part (solid base) |
| Colloidal Silica (Snowtex 30: manufactured by Nissan Kagaku K.K.) | 1.5 parts (solid base) |
| Zinc Stearate (Hydrin Z-7: manufactured by Chukyo Yushi K.K.) | 0.02 parts (solid base) |
| Paraffine Wax (Hydrin P-7: manufactured by Chukyo Yushi K.K.) | 0.02 parts (solid base) |

Coating for Production of Recording Sheet

On a 75micron-thick transparentpolyethylene terephthalate film the coating composition for a protective layer was coated and dried to form the protective layer of a dry coverage of 2 g/m$^2$. On the protective layer, the coating composition (A) was coated and dried to form the photo- and heat-sensitive layer of a dry coverage of 12 g/m$^2$. Thus, a photo- and heat-sensitive recording material was obtained.

A haze transmittance of the thus obtained photo- and heat-sensitive recording material was measured with an integrating sphere process HTR meter made by Nippon eimitsu Kogyo K.K.. In addition, the transparency of this material was ascertained by observing with naked eyes.

The results obtained are shown in Table 1.

Then, the photo- and heat-sensitive recording material was printed with a Hitachi Hi-Fax 400 to result in yellow coloration.

Thereafter, the recording material was exposed to light for 10 seconds with a Ricopy Superdry 100, and heated again at 120 C for 5 seconds with a hot block. However, re-coloration did not take place. Thus, the yellow image excellent in fixability was obtained.

On the other hand, an transmissible original was superposed on the surface of the photo- and heat-sensitive layer of the recording material, exposed to light for 10 seconds with a Ricopy Superdry 100, and then heated for 1 second with a 120 C hot block, resulting in the formation of a clear positive yellow image.

Next, the image-recorded materials obtained by the foregoing recording processes, respectively, were placed on an overhead projector, and the recorded images were projected on a screen. The projected images each was clear transparent yellow image, and no stain was observed in the background area.

EXAMPLE 2

Another photo- and heat sensitive recording material was produced in the same manner as in Example 1, except the following coupler was used in place of the coupler used in Example 1:

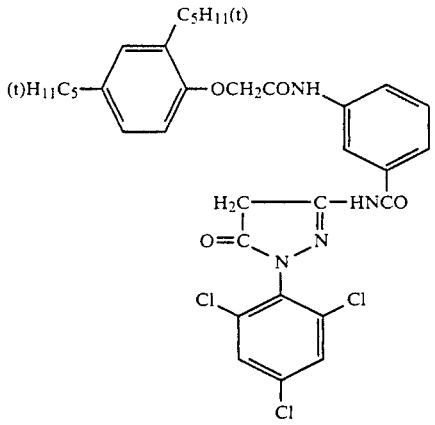

The transparency of the thus obtained photo- and heat-sensitive recording material was evaluated by the same method as in Example 1. The results obtained are shown in Table 1, too.

Heat-sensitive recording was performed using this recording material in the same manner as in Example 1, and thereby a magenta image excellent in fixability was obtained.

On the other hand, photo-sensitive recording was also performed using this photo- and heat-sensitive recording material in the same manner as in Example 1, resulting in the formation of clear positive magenta image.

Then, the image-recorded materials obtained by the foregoing recording processes, respectively, were placed on an overhead projector, and the recorded images were projected on a screen. The projected images each was clear transparent magenta image, and no stain was observed in the background area.

EXAMPLE 3

The recorded images obtained in Example 1 and Example 2 by the foregoing heat-sensitive or photo-sensitive recording process were superposed upon each other, and the color of the part where the two colors overlapped each other was observed by the naked eye. Therein, turbidnessfree, clear orange color was observed.

COMPARATIVE EXAMPLE 1

Preparation of Coupler/Base Dispersion B

The same coupler, base, and polyvinyl alcohol solution as contained in the coupler/base dispersion A were mixed and dispersed with a Dyno Mill (trade name, produced by Willy A Bachofen A.G(trade name)) to obtain a dispersion having a mean particle diameter of 3 microns, which differed from the coupler/base dispersion A in the absence of the tricresyl phosphate and ethyl acetate.

Preparation of Color-Producing Aid Dispersion B

| Color-producing Aids | |
|---|---|
| 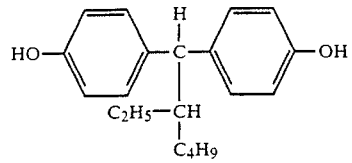 | 25 parts |
| and | |
| 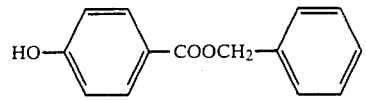 | 3 parts |
| 4 wt % Aqueous Solution of Polyvinyl Alcohol | 138 parts |

The above-described ingredients were mixed and dispersed with a Dyno mill to obtain a dispersion having a mean particle diameter of 3 microns.

Preparation of Coating Composition B

The coating composition B was prepared in the same manner as the coating composition A, except 3.7 parts of the coupler/base dispersion A and 3.7 parts of the color-producing aid dispersion B were used in place of the coupler/base dispersion A.

Coating for Production of Recording Sheet

A photo- and heat-sensitive recording material for comparison was produced in the same manner as in Example 1, except the coating composition B was used in place of the coating composition A.

The transparency of this photo- and heat-sensitive recording material was evaluated by the same method as in Example 1.

TABLE 1

| Kind of Photo- and Heat-Sensitive Material | Haze Transmittance | Transparency |
|---|---|---|
| Example 1 | 12 (%) | good |
| Example 2 | 12 (%) | good |
| Comparative Example 1 | 87 (%) | bad |

What is claimed is:

1. A process to prepare a photo- and heat-sensitive recording material excellent in fixability consisting essentially of a support having on one side thereon at least one photo- and heat-sensitive layer having a haze % of less than 30 containing a photo-decomposable diazo compound and a coupler, said coupler being a compound which forms color by coupling with the diazo compound, comprising microencapsulating either the diazo compound or the coupler wherein the component to be microencapsulated is present in a concentration of 0.2 wt% or more, dissolving the remainder component into a high boiling point organic solvent slightly soluble or insoluble in water, dispersing the resulting solution containing the remainder component in an aqueous solution to form an emulsified dispersion having an oil size diameter of less than 7 microns and an oil phase-/aqueous phase weight ratio of from 0.02 to 0.6, mixing the thus obtained microcapsule solution and emulsified dispersion, coating the resultant mixture on one side of the support, then drying the coat.

2. The process as claimed in claim 1, wherein said organic solvent which is slightly soluble or insoluble in water is an ester compound.

* * * * *